US008550862B2

(12) United States Patent
Krautkrämer

(10) Patent No.: US 8,550,862 B2
(45) Date of Patent: Oct. 8, 2013

(54) SHIP PROPULSION SYSTEM HAVING A PUMP JET

(75) Inventor: Gerd Krautkrämer, Spay/Rhein (DE)

(73) Assignee: Schottel GmbH, Spay/Rhein (DE)

( * ) Notice: Subject to any disclaimer, the term of this patent is extended or adjusted under 35 U.S.C. 154(b) by 204 days.

(21) Appl. No.: 12/743,666

(22) PCT Filed: Dec. 5, 2008

(86) PCT No.: PCT/DE2008/002042

§ 371 (c)(1),
(2), (4) Date: May 19, 2010

(87) PCT Pub. No.: WO2009/071077

PCT Pub. Date: Jun. 11, 2009

(65) Prior Publication Data

US 2010/0267295 A1 Oct. 21, 2010

(30) Foreign Application Priority Data

Dec. 5, 2007 (DE) ..... 20 2007 016 992 U

(51) Int. Cl.
*B63H 11/04* (2006.01)

(52) U.S. Cl.
USPC ..... 440/38

(58) Field of Classification Search
USPC ..... 440/6, 66, 67, 76, 38–47; 310/24; 417/201, 348–357, 423.1, 423.7, 157, 410.2, 417/410.3, 43.1; 415/1, 90, 120; 505/166; 416/3, 90 A, 93 A, 92, 91, 155
See application file for complete search history.

(56) References Cited

U.S. PATENT DOCUMENTS

| | | | | |
|---|---|---|---|---|
| 4,419,082 | A | 12/1983 | Krautkremer et al. | |
| 4,838,821 | A * | 6/1989 | Krautkremer | 440/40 |
| 5,220,231 | A * | 6/1993 | Veronesi et al. | 310/90 |
| 5,470,208 | A * | 11/1995 | Kletschka | 417/356 |
| 5,520,557 | A | 5/1996 | Kaul et al. | |
| 6,500,035 | B2 * | 12/2002 | Terlouw | 440/38 |
| 6,641,378 | B2 * | 11/2003 | Davis et al. | 417/423.7 |
| 7,061,147 | B2 * | 6/2006 | Ries | 310/54 |
| 7,125,224 | B2 * | 10/2006 | Raymond | 415/203 |
| 7,278,895 | B2 * | 10/2007 | Levander | 440/83 |

FOREIGN PATENT DOCUMENTS

| | | | |
|---|---|---|---|
| DE | 19905141 | A1 | 11/1999 |
| EP | 0241730 | A1 | 10/1987 |
| EP | 0612657 | | 8/1994 |
| JP | 8244684 | A | 9/1996 |
| JP | 2007245948 | A | 9/2007 |
| WO | 2004/113717 | A1 | 12/2004 |

OTHER PUBLICATIONS

Cronk, R. (2002) Optimal Electric Ship Propulsion Solution, Maritime Reporter. Retrieved Apr. 25, 2012 from the following website: http://www.greatwriting.com/ABOUT_DOWNLOADS/American_Super.pdf.*

(Continued)

*Primary Examiner* — Stephen Avila
*Assistant Examiner* — Anthony Wiest
(74) *Attorney, Agent, or Firm* — Fleit Gibbons Gutman Bongini & Bianco PL; Martin Fleit; Paul D. Bianco

(57) ABSTRACT

The invention relates to a ship propulsion system (S) having a pump jet (P) comprising a pump housing (G) and a drive motor, wherein the drive motor is a solenoid motor (M) integrated into the pump housing (G).

23 Claims, 6 Drawing Sheets

(56) References Cited

OTHER PUBLICATIONS

English translation of International Preliminary Report on Patentability for PCT/DE2008/002042 filed Dec. 5, 2008 published Dec. 6, 2010.

English translation of the Written Opinion of the International Search Authority for PCT/DE2008/002042 filed Dec. 5, 2008 published Dec. 6, 2010.

International Search Report for PCT/DE2008/002042 filed Dec. 5, 2008 published Oct. 28, 2010.

* cited by examiner

SHIP PROPULSION SYSTEM HAVING A PUMP JET

FIELD OF THE INVENTION

The invention relates to a ship propulsion system (S) having a pump jet according to EP 0 612 657.

BACKGROUND OF THE INVENTION

Ship propulsion systems of this kind are known from the prior art and contain a pump jet as the primary and/or as auxiliary propulsion system. The energy is supplied, for example, firstly via a transmission having optionally an inlet-connected diesel, electric or hydraulic motor, or directly via an impeller shaft by means of a motor arranged outside of the propulsion system. Now the used electric motors pertain to conventional electric motors.

SUMMARY OF THE INVENTION

Even though ship propulsion systems of this kind have exceptionally efficient designs, the present invention has and achieves the objective of an additional improvement, in particular with regard to simplification of the design, efficiency of the propulsion system and expansion of potential applications thereof.

In this regard the invention creates a ship propulsion system with a pump jet which contains a pump housing and a propulsion engine, wherein the propulsion engine is a solenoid motor integrated into the pump housing.

Alternatively, the invention creates a ship propulsion system with a pump jet which contains a pump housing and a propulsion engine, wherein the propulsion engine is a high-temperature superconductor motor integrated into the pump housing.

The pump jet is preferably steerable all around.

Furthermore, it is an advantage as per this invention that the solenoid motor or high-temperature superconductor motor contains a rotor which is a constituent of an impeller of the pump jet.

An additional preferred embodiment consists in that the solenoid motor or high-temperature superconducting motor contains a stator which is a constituent of a diffuser inner ring of the pump jet.

An additional preferred embodiment consists in that the pumped medium is used especially as such, and also as lubricant and/or coolant.

Yet an additional preferred embodiment consists in that the propulsion system of the pump jet does not contain any force-transferring parts, such as gears, roller bearings and/or shafts. And an additional preferred embodiment consists in that deflector devices are provided which are arranged and/or are designed in the interior chamber of the diffuser housing.

Preferably the deflector devices are arranged and/or designed in order to release a water jet free from eddies into the interior chamber of the diffuser housing and/or to direct it so that water emerges with little or no internal eddies from a nozzle of the pump jet or so that a defined quantity of water per unit time, in particular equal amounts of water per unit time, emerges through individual nozzles and/or emerges preferably with no internal eddies, in order to attain an optimum thrust action of the pump jet. In addition or as an alternative, it is preferable that the deflector devices contain at least the shape of the interior chamber of the diffuser housing. An additional, preferred embodiment in this regard consists in that the deflector devices include a region of constant cross sectional profile of the interior chamber of the diffuser housing and/or that the deflector devices contain a region of reduced cross sectional profile of the interior chamber of the diffuser housing and/or that the deflector devices contain a region of enlarged cross sectional profile of the interior chamber of the diffuser housing. Furthermore, the deflector devices can contain in addition or alternatively at least one guide vane in the interior chamber of the diffuser housing.

An additional, preferred embodiment of the invention disclosed above and of its possible implementations, and also an independent aspect of the invention worthy of protection by itself, is that the rotor contains a rotation axis which does not align with a control axis of the pump jet.

This can be designed in a favorable manner in that the axis of rotation of the rotor is offset with respect to the control axis of the pump jet, wherein it is additionally preferred that the axis of rotation of the rotor and the control axis of the pump jet are parallel. Alternatively or additionally, it is an advantage that the rotation axis of the rotor and the control axis of the pump jet are inclined toward each other, wherein furthermore in particular the rotation axis of the rotor and the control axis of the pump jet intersect at one point.

Additionally preferred and/or favorable embodiments of the invention are evident from the claims and combinations thereof, and from the entire application documentation herein.

BRIEF DESCRIPTION OF THE DRAWINGS

The invention will be explained in greater detail below based on design embodiments, with reference to the figures, which illustrate only examples. We have.

DETAILED DESCRIPTION OF THE INVENTION

The invention will be explained in a purely exemplary manner based on the design embodiments and examples described below and illustrated in the figures, that is, the invention is not restricted to these design embodiments and examples or to the combinations of features presented within these design embodiments and examples. Features relevant to the process and apparatus are each indicated analogously from apparatus and/or process descriptions.

Individual features which are specified and/or disclosed in connection with a definitive sample embodiment are not restricted to this sample embodiment or to a combination with the other features of this sample embodiment, but rather can be combined within the scope of the technically feasible, with any other variant, even if they are not discussed specifically in these present documents.

The same reference numbers in the individual figures and illustrations represent the same or similar or equivalent or similar operating components. Based on the illustrations in the figures, those features which are not provided with reference numbers are also made clear, independently of whether such features are specifically described herein or not. Additionally, features included in the present description but which are not visible or illustrated in the figures, are readily understood by an ordinary technician skilled in the art.

Figure 1:
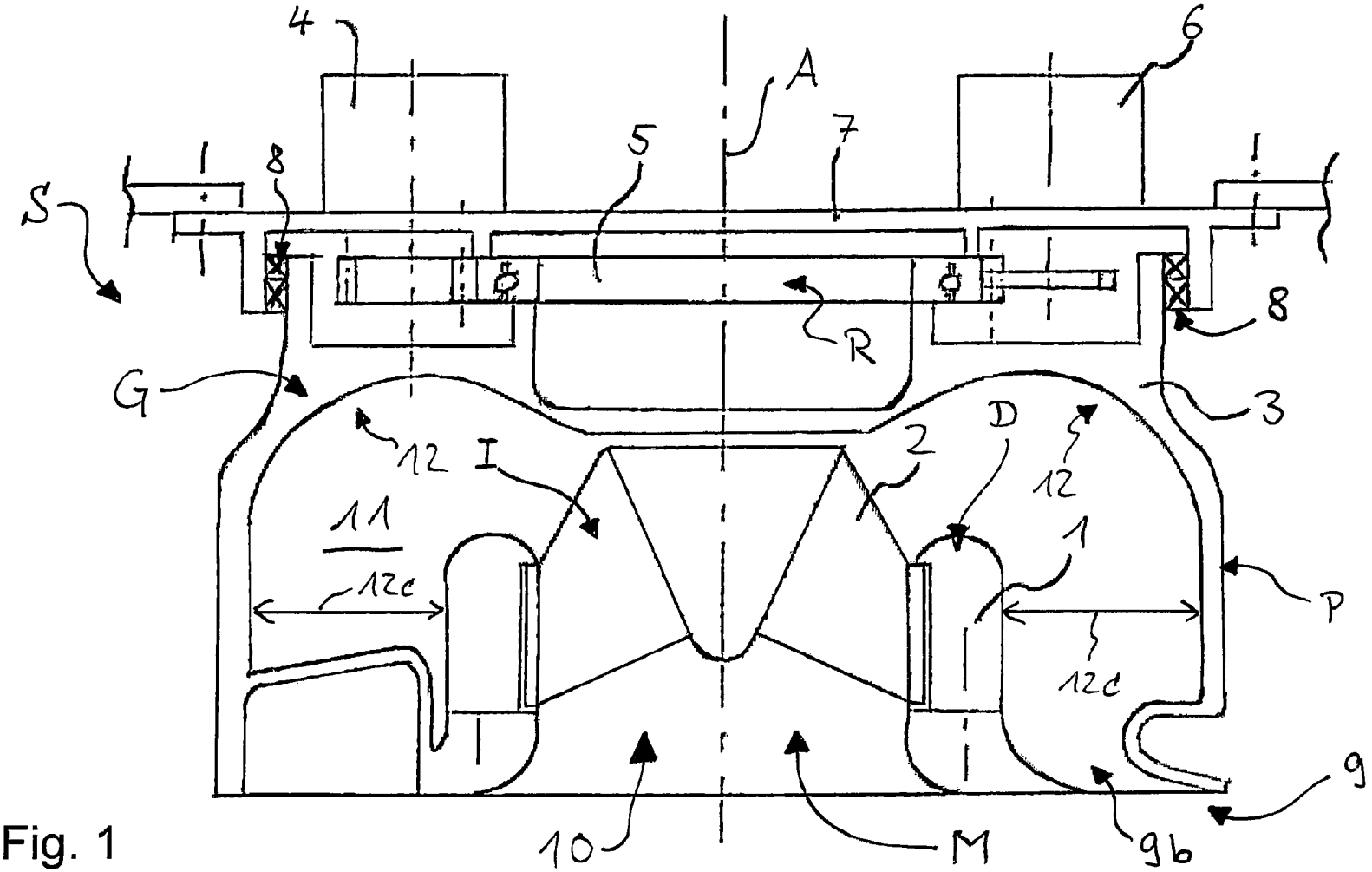
FIG. 1 shows a schematic, cross-sectional view of a first embodiment of a ship propulsion system with a pump jet.

FIG. 1 presents a schematic of a ship propulsion system S with a pump jet P in a longitudinal cross section. The pump jet P contains a solenoid motor M which is integrated into the flow- or pump housing G, as propulsion engine with a stator 1 and a rotor 2. The rotor 2 is developed as an impeller outer ring I and the stator 1 is integrated into a diffuser inner ring D of the pump housing G, which contains a diffuser housing 3 or is overall designed as such. An additional control motor 4, a control transmission 5 with a spur gear R, for example, and also a reply transmitter 6 and a spring plate 7 also belong to the pump jet P.

Figure 2:
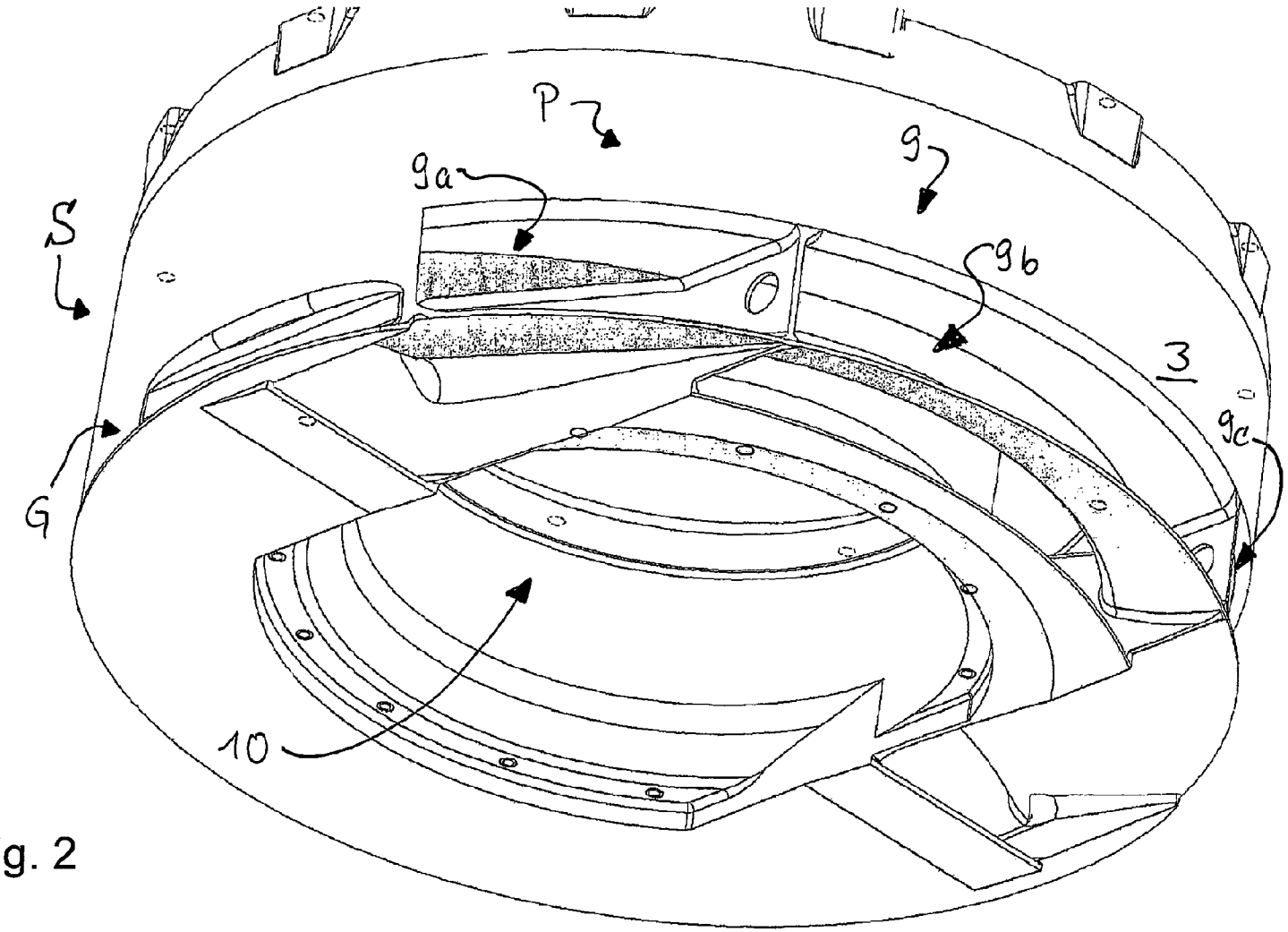
FIG. 2 shows a schematic perspective view of the ship propulsion system with a pump jet in a first embodiment.
Figure 3:
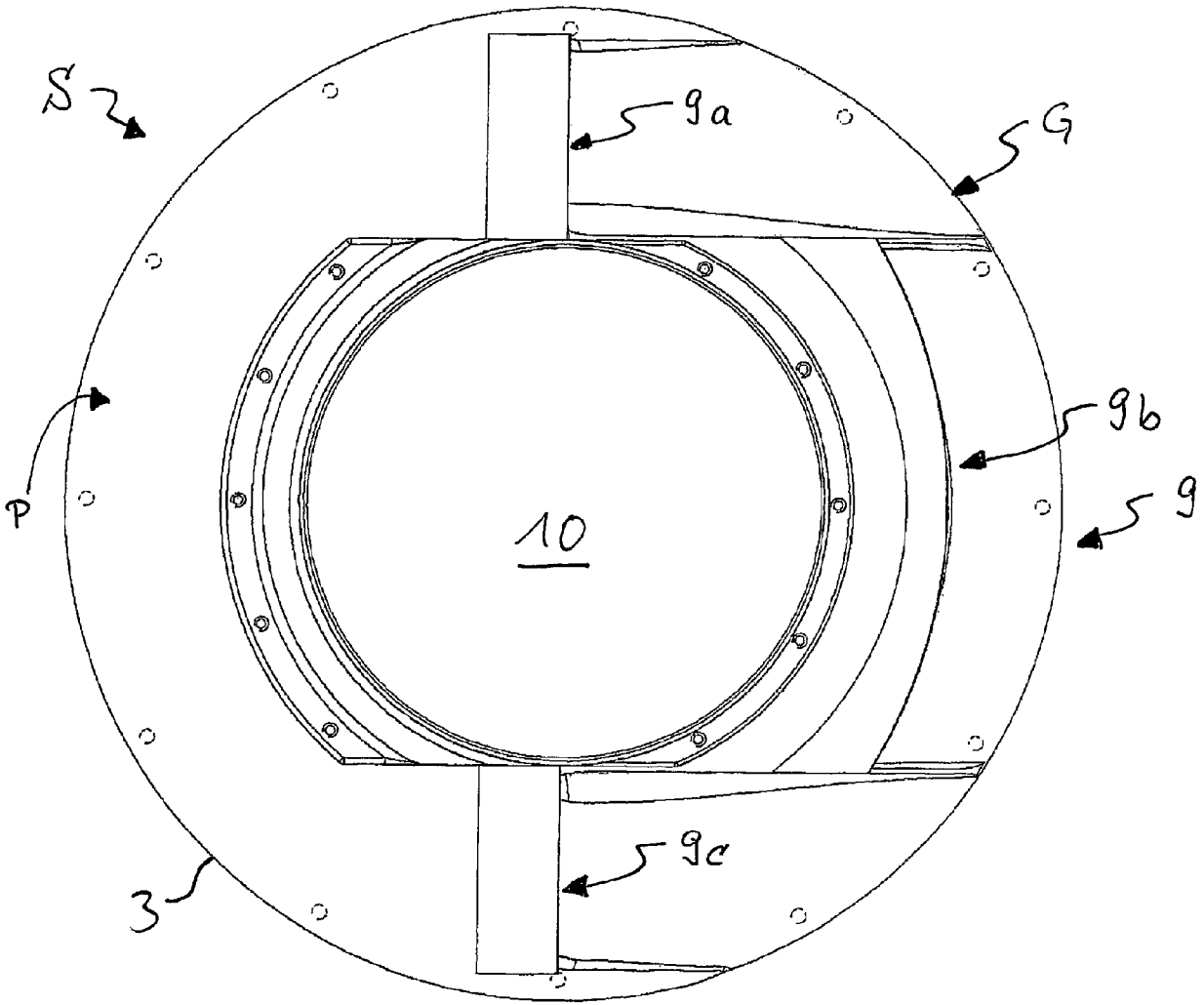
FIG. 3 shows a schematic view of the ship propulsion system with a pump jet in a first embodiment from below, i.e. of a pump jet attached to a ship stern as seen looking toward the ship stern.
Figure 4:
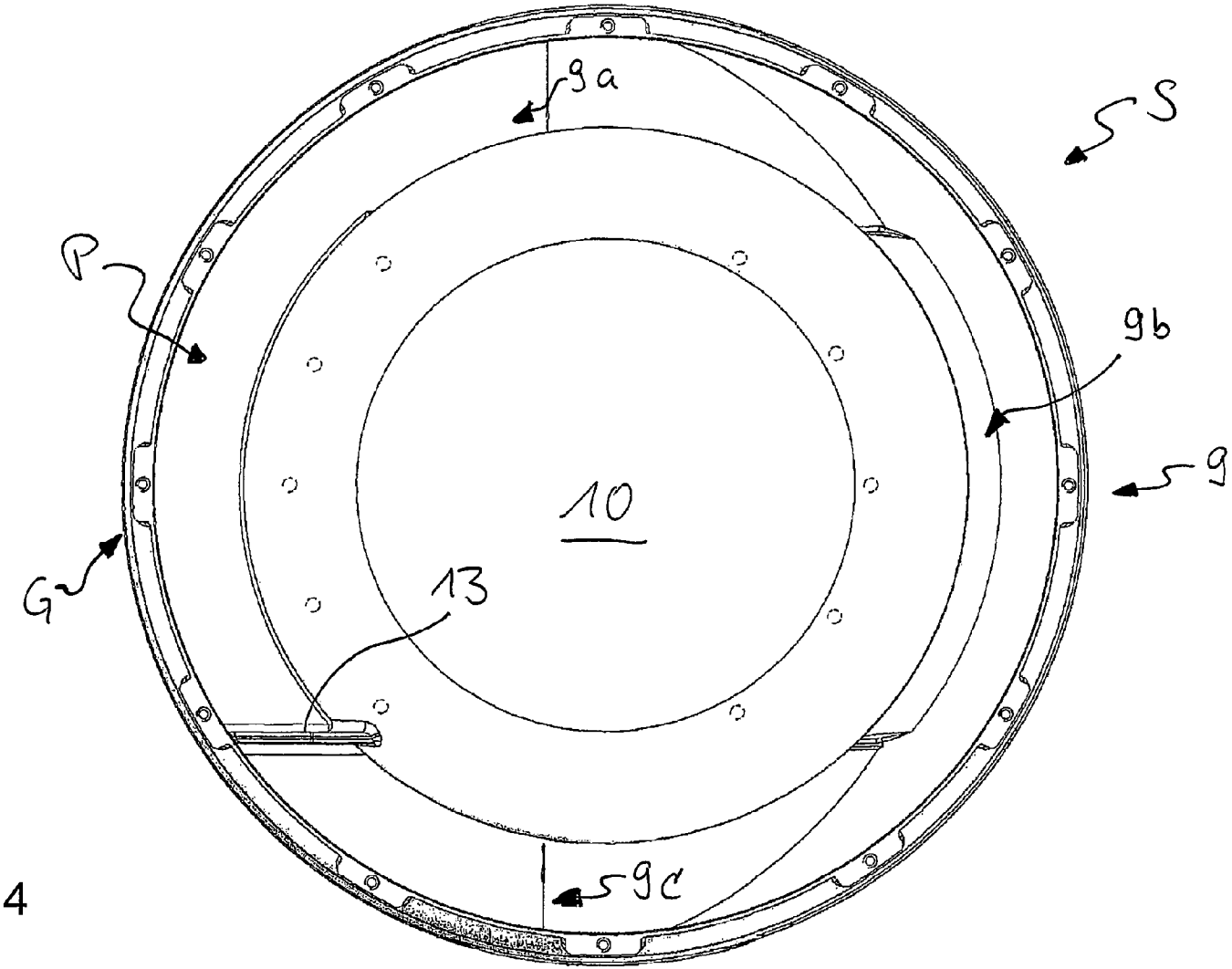
FIG. 4 shows a schematic view of the ship propulsion system with a pump jet in a first embodiment from inside to outside, i.e. of a pump jet attached to a ship stern as seen looking away from the ship stern

FIG. 2 shows the ship propulsion system S with the pump jet P of the first embodiment in a perspective, schematic view. FIG. 3 shows the ship propulsion system S with the pump jet P of the first embodiment in a schematic view from below, that is, with pump jet arranged on a ship stern as seen looking toward the ship's stern. FIG. 4 shows the ship propulsion system S with the pump jet P of the first embodiment in a schematic view from inside to outside, that is, with pump jet arranged on a ship's stern as seen looking away from the ship's stern.

In particular we are dealing with a steerable all around ship propulsion system S whose pump jet P can rotate by 360°. In addition to the fact that the propulsion of the pump jet P occurs via a solenoid motor M integrated into the pump housing G, a high-temperature superconducting or HTSL motor (not separately illustrated) can also be provided for the propulsion, wherein the rotor/stator 2 is equally a constituent of the impeller I and the stator 1 is an integral component of the diffuser inner ring D. Therefore, the conventional type of power transmission using drive motor, clutch and articulated shaft are omitted. Thus a very compact propulsion unit is obtained which can be installed in nearly any floating apparatus.

Due to the propulsion of the pump jet P with a solenoid motor M or HTSL motor, no transmission parts such as gears, shafts, or roller bearings are needed. Consequently this means that the pump jet P can be classed as a very low noise and low vibration, high-efficiency motor. Furthermore, no oil reservoir is needed for lubrication and cooling of rotating parts, which makes the pump jet P an oil-free and low-maintenance unit.

Particular advantages are as follows:

compact design
high efficiency
very low noise
low vibration
oil-free
low maintenance By means of the control motor 4, the pump housing G which contains the diffuser housing 3 or is designed overall as one such housing, can be rotated in bearings 8 opposite the spring plate 7 around a control axis A for preferably 360°, so that nozzles 9, of which only one central nozzle 9*b* of three nozzles 9*a*, 9*b* and 9*c* (see FIGS. 2, 3 and 4) is presented in the cross sectional illustration in FIG. 1, can be controlled in a desired direction.

Water is drawn by means of the rotor 2 into an inner chamber 11 of the diffuser housing 3 through an intake opening 10. The jet of water flowing in this manner into the inner chamber 11 of the diffuser housing 3 is diverted due to the shape of the inner chamber 11 of the diffuser housing 3, so that it emerges in the desired direction through the nozzle 9 from the pump housing G, according to the rotational position adjusted by means of the control motor 4. Since a deflection of the water jet occurs due to the shape of the inner chamber 11 of the diffuser housing 3 which takes place through the intake opening 10 into the inner chamber 11 of the diffuser housing 3, this then means that the diffuser housing 3 or the pump housing G is thus also simultaneously a diverter housing. The configuration in the first embodiment shown in FIG. 1 is bulge-like around the propulsion motor with the stator 1 in the diffuser inner ring D of the pump housing G and the rotor 2 as impeller outer ring I. The interior chamber 11 of the diffuser housing or diverter housing 3 with this specific shape thus represents the deflector devices 12.

To additionally affect the flow of the water drawn in through the intake opening 10 along its path to the nozzles 9, as is shown in the illustration in FIG. 4, a guide vane 13 is provided as a constituent of the deflector devices 12. Depending on the additional configuration of the deflector devices 12, several and/or differently placed and designed guide vanes can also be provided. The purpose of the guide vanes, like that of guide vane 13, is that the stream of water swirled up by the fast rotating rotor 2 and directed into the interior chamber 11 of the diffuser housing or diverter housing 3 is "calmed" in conjunction with the deflector devices 12 and is directed so that equal amounts or in general the desired amount of water per time unit emerges through the individual nozzles 9*a*, 9*b* and 9*c* with the minimum of internal eddies, in order to attain an optimum thrust effect of the pump jet P.

Figure 5:
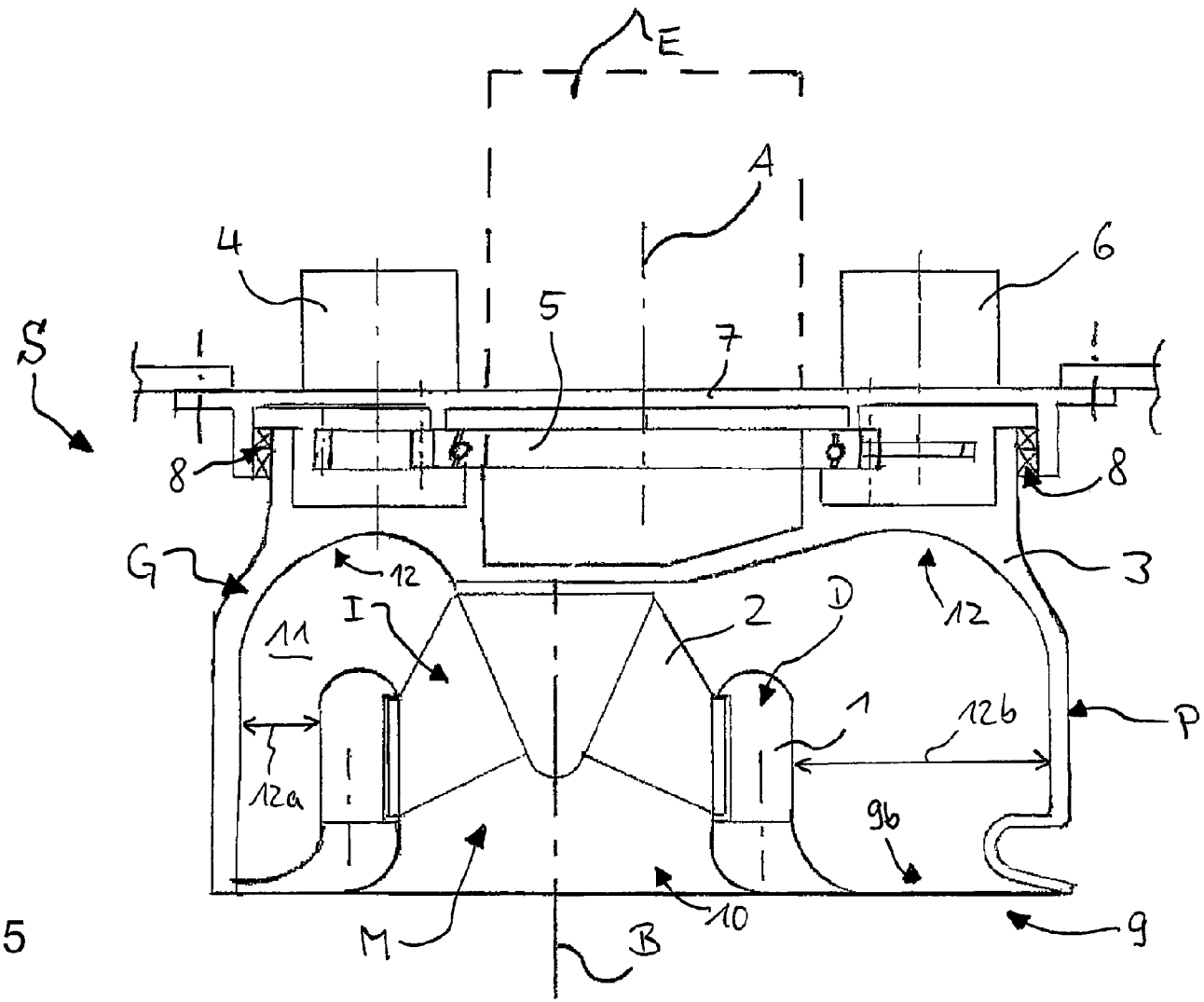
FIG. 5 shows a second embodiment of a ship propulsion system with a pump jet in a schematic cross section.

In a schematic, cross sectional illustration analogous to FIG. 1, FIG. 5 shows a second embodiment of a ship propulsion system S with a pump jet P. To avoid repetition with respect to all components, their arrangement and effect refer to the description of the first embodiment as per FIGS. 1-4.

In contrast to the first embodiment, in the second embodiment the rotor 2 with an axis of rotation B is provided at an offset with respect to the control axis A of the pump jet P. The control axis A of pump jet P and the axis of rotation B of rotor 2, however, are aligned parallel to each other.

Furthermore, in the second embodiment according to FIG. 5 herein, the deflector devices 12—provided they are formed by the shape of the interior chamber 11 of the diffuser housing or diverter housing 3 or by the pump housing G—are no longer uniform around the rotor 2 in comparison to the first embodiment as per FIG. 1. The deflector devices 12 have a region 12*a* of smaller cross section and a region 12*b* of larger cross section; however, the cross sectional profile in the entire region 12*c* in the first embodiment as per FIG. 1 is constant. A cross section increasing in size toward the nozzles 9 according to region 12*b* in the second embodiment as per FIG. 5—relative to the cross section in region 12*a*—has a diffusion effect or diffuser effect, for example.

Specifically, the offset arrangement of control axis A of pump jet P and axis of rotation B of the impeller I or rotor 2 promotes the configuration of the deflector devices 12 with the region 12*a* of smaller cross section and the region 12*b* of larger cross section. However, it is not absolutely necessary to combine the two aspects of axial offset and of non-uniform configuration of the deflector devices 12 in the interior chamber 11 of the diffuser housing or diverter housing 3 or of the pump housing G.

Figure 6:
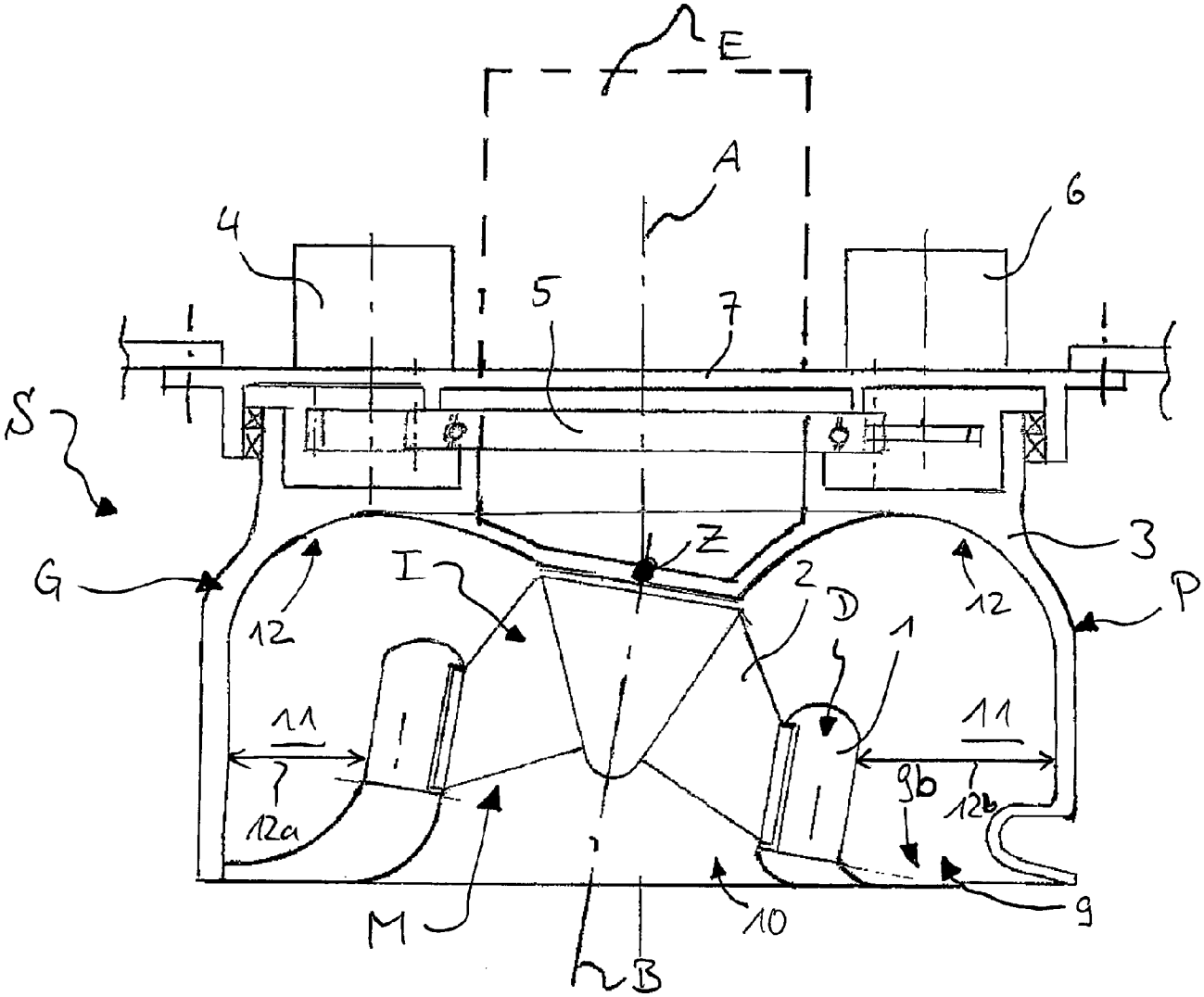
FIG. 6 shows a third embodiment of a ship propulsion system with a pump jet in a schematic cross section.

FIG. 6 presents a third embodiment of a ship propulsion system S with a pump jet P in a schematic illustration analogous to the representations in FIGS. 1 and 5. To avoid repetition with respect to all components, their arrangement and effect refer to the description of the first embodiment as per FIGS. 1-4.

In contrast to the first embodiment, in the third embodiment the rotor 2 has an axis of rotation B which is inclined with respect to the control axis A of pump jet P. However, the control axis A of pump jet P and the axis of rotation B of rotor 2 intersect at a point Z.

Furthermore, in the third embodiment according to FIG. 6 as well as for the second embodiment according to FIG. 5, the deflector devices 12—provided they are formed by the shape of the interior chamber 11 of the diffuser housing or diverter housing 3 or by the pump housing G—are no longer uniform around the rotor 2 in comparison to the first embodiment as per FIG. 1, due to the slanting position of said rotor. Again as in the second embodiment as per FIG. 5, the deflector devices 12 have a region 12*a* of smaller cross section and a region 12*b* of larger cross section; however, as was already explained above, the cross sectional profile in the entire region 12*c* in the first embodiment as per FIG. 1 is constant. A cross section increasing in size toward the nozzles 9 according to region 12*b* in the second [sic] embodiment as per FIG. 6—relative to the cross section in region 12*a*—has a diffusion effect or diffuser effect, for example.

Specifically, the slanting arrangement of axis of rotation B of the impeller I or of rotor 2 to the control axis A of the pump jet P promotes the configuration of the deflector devices 12 with the region 12*a* of smaller cross section and the region 12*b* of larger cross section. But in the configuration according to the third embodiment which is illustrated in FIG. 6, the regions 12*a* and 12*b* do not have a constant cross section, neither in the perimeter section of the bulge-shaped or ring-shaped interior chamber 11 of the diffuser housing or diverter housing 3 or of pump housing G, as is the case in the second embodiment as per FIG. 5.

Furthermore, in the third embodiment which is illustrated in FIG. 6, it is not absolutely necessary to incline the axes toward each other or to use unequal configuration of the deflector devices 12 in the interior chamber 11 of the diffuser housing or diverter housing 3 or of the pump housing P.

The circumstance wherein the axis of rotation B of the impeller I or rotor 2 and the control axis A of the pump jet P do not align, or stated differently, do not coincide with each other, can also be viewed as an independent and thus stand-alone invention worthy of patent protection independently of the configuration of the ship propulsion system S with a pump jet P, which contains a pump housing G and a propulsion engine, wherein the propulsion engine is a solenoid motor M or high-temperature superconductor motor integrated into the pump housing G. The non-aligned arrangement of the rotation axis B of the impeller I or rotor 2 and of the control axis A of pump jet P herein is the generally applicable formulation which covers the embodiments according to FIGS. 5 and 6, in which in the second embodiment, rotor 2 is provided with a rotation axis B offset with respect to the control axis A of the pump jet P and/or in the third embodiment the rotor 2 has an axis of rotation B which is inclined with respect to the control axis A of pump jet P, wherein in particular, but not necessarily, the control axis A of pump jet P and the axis of rotation B of rotor 2 intersect at one point Z.

In the event that the invention feature is taken by itself, i.e., that the axis of rotation B of impeller I or of rotor 2 and the control axis A of pump jet P do not align, then in particular as propulsion motor an electric motor E, such as in particular an asynchronous motor, synchronous motor or permanent solenoid motor can be provided which is arranged on the pump housing G or is partly integrated therein. One such electric motor E is shown in FIGS. 5 and 6 as indicated by dashed lines in connection with the illustration of the second and third embodiments. If one such electric motor E is provided, it will replace the solenoid motor M or the HTSL motor which is provided in the first embodiment as per FIG. 1 as stand-alone propulsion motor and not only that, but in addition in the second and third embodiments each can be provided as a stand-alone propulsion motor. As stated above, when the circumstance of non-aligned axes, namely of rotation axis B of the impeller I or rotor 2 and the control axis A of pump jet P are viewed alone, then the variants of a propulsion motor in the form of a solenoid motor M or HTSL motor integrated into the pump housing G, or of an electric motor E set onto or partly integrated into the pump housing G, represent alternative designs. When using an electric motor E as propulsion motor set onto the pump housing G or partly integrated therein, of course power transmission components, such as gears, roller bearings and/or shafts are needed in order to ensure the rotational connection between one such propulsion motor and the impeller of the pump jet P. But this is a circumstance which belongs to the standard skill of an ordinary technician and in this regard is not a constituent of the present invention and is also not a feature of the invention that the axis of rotation B of rotor 2 and the control axis A of pump jet P do not align.

The invention has merely been disclosed in an exemplary fashion based on the design embodiments in the description and in the figures and is not restricted therein, but rather comprises all variations, modifications, substitutions and combinations which the ordinary technician can extract from the present documents, in particular within the scope of the claims and of the general disclosure in the introduction of this description and in the description of the design embodiments and which can be combined with his technical skill knowledge with the prior art. In particular, all specific details and potential embodiments of the invention and their design examples can be combined.

The invention claimed is:

1. A ship propulsion system comprising:

a pump jet that moves the ship through the water including a pump housing having an intake opening and at least one output nozzle on the same side of the housing, and a drive motor integrated into the pump housing, the drive motor including a rotor and a stator, the rotor rotatably mounted within the pump housing and supported only by the stator, for drawing a fluid through the intake opening, the stator fixed to the housing and cooperative with the rotor to form an electric motor.

2. The ship propulsion system according to claim 1, wherein the drive motor is a high-temperature superconductor motor integrated into the pump housing.

3. The ship propulsion system according to claim 1, wherein the pump jet is fully rotatable with respect to a control axis aligned with a rotational axis of the rotor.

4. The ship propulsion system according to claim 1, wherein the rotor is a constituent of an impeller of the pump jet.

5. The ship propulsion system according to claim 1, wherein the stator is provided in a diffuser inner ring substantially circumferentially surrounding the rotor of the pump jet.

6. The ship propulsion system according to claim 1, wherein the pump jet does not contain gears, roller bearings or shafts.

7. The ship propulsion system according to claim 1, wherein the rotation axis of the rotor is offset from a control axis about which the pump housing may be rotated.

8. The ship propulsion system according to claim 7, wherein the rotation axis of the rotor and the control axis are substantially parallel.

9. The ship propulsion system according to claim 7, wherein the rotation axis of the rotor is angled with respect to the control axis.

10. The ship propulsion system according to claim 9, wherein the rotation axis of the rotor and the control axis intersect at a point within the pump housing.

11. The ship propulsion system according to claim 1, further including:

at least one interior chamber in fluid communication with said intake opening and including at least one deflector arranged to direct fluid flow through the at least one interior chamber to be released through the at least one output nozzle, the intake opening and the at least one output nozzle positioned upon the same side of the housing.

12. The ship propulsion system according to claim 11, wherein the at least one deflector reduces or eliminates fluid swirl within the at least one interior chamber thereby releasing a fluid jet from the at least one output nozzle with a reduced number of eddies permitting a defined quantity of water per unit time, in particular equal amounts of water per unit time, to emerge through the at least one output nozzle in order to attain an optimum thrust action of the pump jet.

13. The ship propulsion system according to claim 11, wherein the at least one deflector at least partly defines the shape of the at least one interior chamber.

14. The ship propulsion system according to claim 13, wherein the at least one interior chamber extends circumferentially about the intake opening, the stator provided as a ring substantially encircling the rotor and provided between the at least a portion of the intake opening and at least a portion of the at least one interior chamber, each interior chamber having a defined cross sectional between the radial edge of the pump housing and the stator.

15. The ship propulsion system according to claim 14, wherein the at least one interior chamber has variable dimensions thereby defining different length cross sectional distances.

16. The ship propulsion system according to claim 11, wherein the at least one deflector includes at least one guide vane in the at least one interior chamber.

17. A ship propulsion system, comprising:

a housing having an intake opening, at least one internal chamber in fluid communication with the intake opening, and at least one nozzle associated with the at least one internal chamber for ejecting fluid from the housing that moves the ship through the water, the intake opening and the at least one nozzle positioned on the same side of the housing;

a motor contained within the housing, the motor including a rotor rotatable within the intake opening for drawing fluid into the intake opening and through the internal chamber, and a stator connected to the housing rotatably supporting the rotor, the stator forming a ring substantially circumventing the intake opening.

18. The ship propulsion system according to claim 17, wherein the stator is a ring substantially circumventing the intake opening.

19. The ship propulsion system according to claim 17, wherein the rotation axis is offset from the control axis.

20. The system of claim 17, further including a plate connected to the ship, the housing coupled to the plate, the plate configured to rotate with respect to the ship to thereby permit rotation of the housing about a control axis, to vary the direction of the fluid ejected through the at least one nozzle.

21. The system of claim 17, wherein the rotor is supported only by the stator upon bearings.

22. The ship propulsion system of claim 21, wherein the pump together with the stator and rotor are rotatably mounted to the ship.

23. A ship propulsion system comprising:

a pump housing having a water intake opening in fluid communication with an interior chamber having a variable cross-sectional dimension, the interior chamber in fluid communication with an outlet port, the intake opening and the outlet nozzle on the same side of the housing;

a stator positioned entirely within the pump housing and water intake opening;

a rotor rotatably supported only by a bearing connected to the stator, the rotor and stator forming an electric motor operative to draw water into the intake opening and expel the water out of the outlet nozzle, to move the ship through water.

* * * * *